United States Patent [19]

Scriven

[11] Patent Number: 4,877,221

[45] Date of Patent: Oct. 31, 1989

[54] EXPANDABLE TAP HOLE PLUG

[75] Inventor: Rick R. Scriven, Riverview, Mich.

[73] Assignee: Tri-Star Manufacturing & Service, Inc., Butler, Pa.

[21] Appl. No.: 279,502

[22] Filed: Dec. 5, 1988

[51] Int. Cl.[4] ..... C21B 7/12

[52] U.S. Cl. ..... 266/272; 266/271

[58] Field of Search ..... 266/272, 45, 287, 271; 222/591, 597

[56] References Cited

U.S. PATENT DOCUMENTS

| | | | |
|---|---|---|---|
| 3,124,854 | 3/1964 | Dore | 266/272 |
| 3,398,945 | 8/1968 | Walpole | 266/272 |
| 3,540,627 | 11/1970 | Armstead | 266/272 |
| 4,030,709 | 6/1977 | Shepard et al. | 266/272 |
| 4,390,170 | 6/1983 | Schaefer et al. | 266/272 |
| 4,471,950 | 9/1984 | LaBate | 266/272 |

*Primary Examiner*—S. Kastler

*Attorney, Agent, or Firm*—Parmelee, Miller, Welsh & Kratz

[57] ABSTRACT

An expandable tap hole plug includes a plug comprising a cylindrical member having a circular nose and an outwardly extending flexible sidewall forming a variable obtuse angle with respect to the nose. The plug is adatepd to be oriented within a tap hole of a metallurgical vessel with the nose directed towards the interior of the vessel. An expander, in the form of a truncated cone, has a base and spokes extending outwardly from the base forming a variable obtuse angle with respect to the base. The expander is inverted relative to the plug and is attached to the plug with the spokes of the expander engaging the sidewall of the plug. The angle between the side section and base of the expander is varied so as to vary the angle of the sidewall of the plug relative to the nose thereof to block the tap hole.

9 Claims, 3 Drawing Sheets

EXPANDABLE TAP HOLE PLUG

BACKGROUND OF THE INVENTION

This invention relates to a plug for a tap hole, and more specifically, to an expandable tap hole plug for use with metallurgical vessels.

Tap hole plugs are used to seal the tap hole of a metallurgical vessel while the vessel is in use. Because the size of such tap holes vary from vessel to vessel and widen with use, it is important that the tap hole plug be adjustable. Further, it is advantageous that such a tap hole plug have a contracted position in which it can easily be inserted within and withdrawn from a tap hole, and an expanded condition in which it securely plugs the tap hole.

U.S. Pat. No. 3,398,945 to Walpole, issued Aug. 27, 1968, shows a conical plug of a porous material that is inserted within an orifice to be plugged. The porosity of the plug allows molten metal to flow into the plug. When the metal cools, it solidifies to block the further flow of metal through the plug. It would be preferred to avoid using the metal that is being stored until required for collection for the plug. Furthermore, the hot atmosphere in the vicinity of the container makes it highly unlikely that the metal can cool to a temperature at which it solidifies and remain solidified until the orifice is unplugged.

U.S. Pat. No. 3,540,627 to Armstead, issued Nov. 17, 1970, uses a conical plug, a resilient refractory fiber pad for the plug and a mat of relatively inexpensive glass fiber interposed between the plug and the pad to provide economical backing for the pad. The plug is a solid, rigid member of fixed configuration that is movable axially to compress the resilient refractory fiber pad and its glass fiber backing against the wall of an orifice to be plugged. In one embodiment, the solid, rigid plug is made hollow to enable cooling air to be furnished about a line of contact between the plug and orifice.

U.S. Pat. No. 4,471,950 to La Bate, issued Sept. 18, 1984, shows a stopper plug formed of refractory materials, fibrous substances and consumable materials in a hollow conical plug that is expandable in a tap hole by movement of a rigid wedge-shaped member therein. The expanded stopper plug is capable of effectively sealing the tap hole for a predetermined time. In case of a slow market for the metal, it may become necessary to store the molten metal for more than said predetermined time.

One type of currently available expandable tap hole plug involves a conically shaped plug having a circular disc movable toward and away from the nose of the plug on a rod. Once the plug is inserted within a tap hole, the disc is moved until it causes the plug to expand to the point where the plug is tightly lodged within the tap hole. Once concern associated with use of such tap hole plugs is that the sidewall of the plug can buckle as the disc is moved relative to the plug. Further, because the point on the plug that is in contact with the inner wall of the tap hole is not necessarily, and most likely is not, the same point wherein the disc contacts the inner surface of the sidewall of the plug when the plug is in its expanded position, the seal between the plug and the tap hole is not as tight as it might be.

It is desired to improve upon the quality of the seal between the tap hole and the plug and to reduce the propensity of the sidewall of the plug to buckle when in its expanded position.

SUMMARY OF THE INVENTION

The expandable tap hole plug of the invention includes a plug comprising a cylindrical member having a circular nose and an outwardly extending flexible sidewall forming a variable obtuse angle with respect to the nose. The plug is adapted to be oriented within a tap hole of a metallurgical vessel with the nose directed towards the interior of the vessel.

An expander, in the form of a truncated cone, has a base and a flexible side section extending outwardly from the base forming a variable obtuse angle with respect to the base. The expander is inverted relative to the plug and is attached to the plug with the side section of the expander engaging the sidewall of the plug. The angle between the side section and base of the expander is varied so as to vary the angle of the sidewall of the plug relative to the nose thereof to substantially block the tap hole.

Because the location on the plug through which the expanding force is applied to the plug is very close to the location on the plug at which the plug contacts the tap hole, the quality of the seal between the tap hole and the plug is superior to that of currently available tap hole plugs. Further, the sidewall of the plug is not likely to buckle when in its expanded position.

DESCRIPTION OF THE DRAWINGS

Other objects and advantages of the present invention will become readily apparent upon reference to the following drawings wherein.

DETAILED DESCRIPTION OF THE PREFERRED EMBODIMENTS

Figure 1:
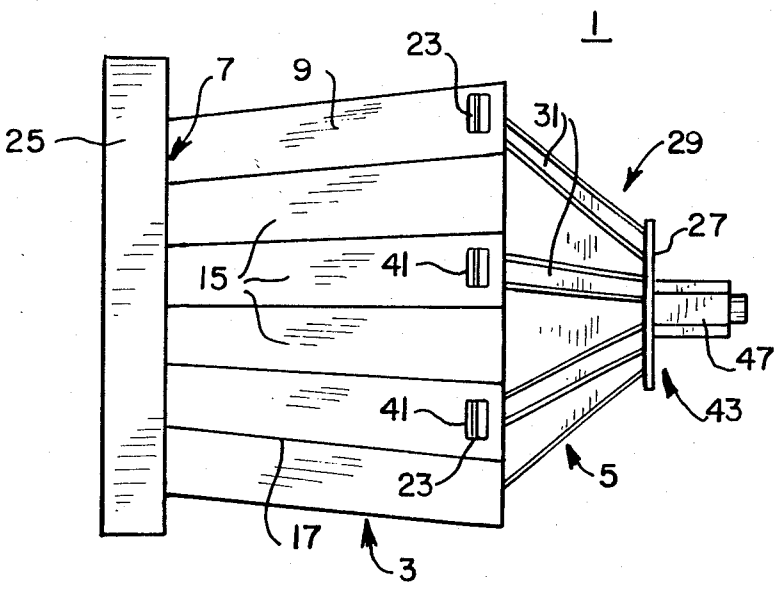
FIG. 1 is an elevational view of the tap hole plug of the invention in its contracted position.
Figure 2:
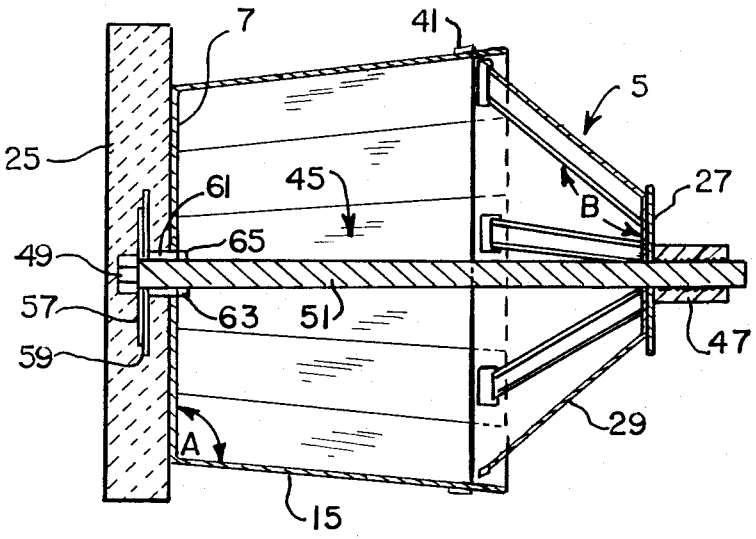
FIG. 2 is a cross-sectional view of the tap hole plug of FIG. 1.

The tap hole plug 1 of the present invention includes a plug 3 and an expander 5. The plug 3 is substantially cylindrical and has a circular nose 7, and an outwardly extending frustro-conical flexible sidewall 9. The sidewall 9 forms a variable obtuse angle A with respect to the nose 7 that varies from about 180°, when the plug 3 is in its fully expanded position to about 90° when the plug 3 is in its fully contracted position. The plug 3 is designed to be oriented within a tap hole 11 of a metallurgical vessel 13 so that the nose 7 is directed inwardly, towards the interior of the vessel 13.

Figure 5:
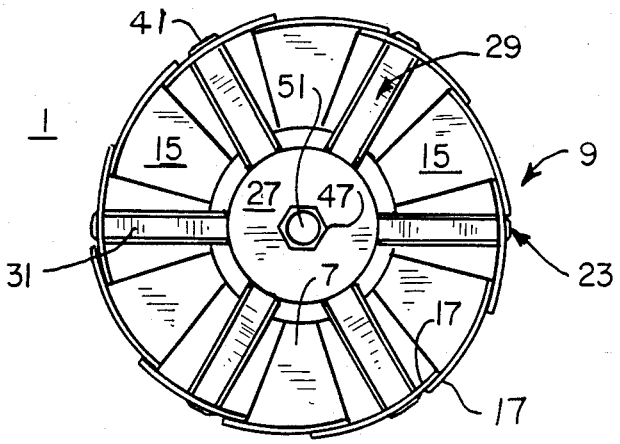
FIG. 5 is a top plan view of the tap hole plug.
Figure 7:
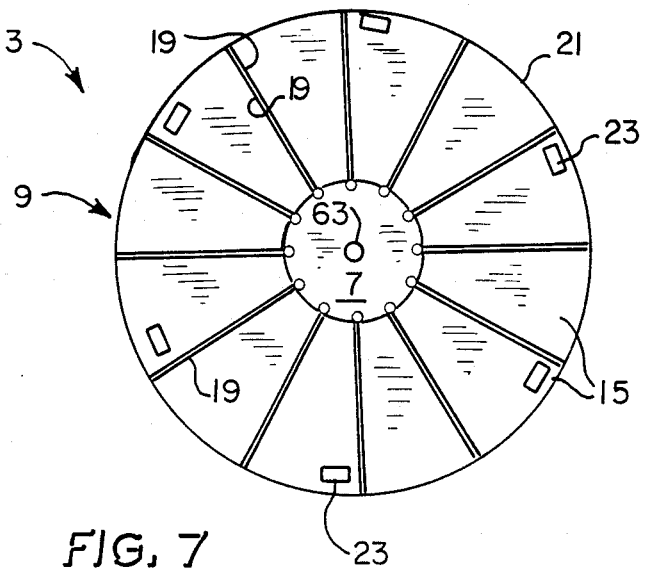
FIG. 7 is a plan view of the plug portion of the expandable tap hole plug prior to formation of the side wall into a frustro-conical position.

Preferably, the sidewall 9 is formed of a plurality of vanes 15 extending radially outwardly from the nose 7 of the plug 3 (FIG. 7). When the sidewall 9 is partially extended, as shown in FIG. 5, the vanes 15 partially overlap. The vanes 15 are slightly angled so as to more easily overlap each other. When the vanes 15 overlap, the overlapping surfaces 17 of adjacent vanes 15 abut each other. When the sidewall 9 of the plug 3 is fully expanded, similar to that shown in FIG. 7, the side edges 19 of adjacent vanes 15 abut each other. Preferably, the circumference of the outermost edge 21 of the sidewall 9 of the plug 3 is about 12 to about 18 inches. Most preferably, the circumference is about 16 inches. The sidewall 9 of the plug 3 preferably includes a plurality of slots 23 spaced annularly about the sidewall 9 to attach the plug 3 to the expander 5. The slots 23 are adjacent the outer edges of the vanes 15.

Figure 3:
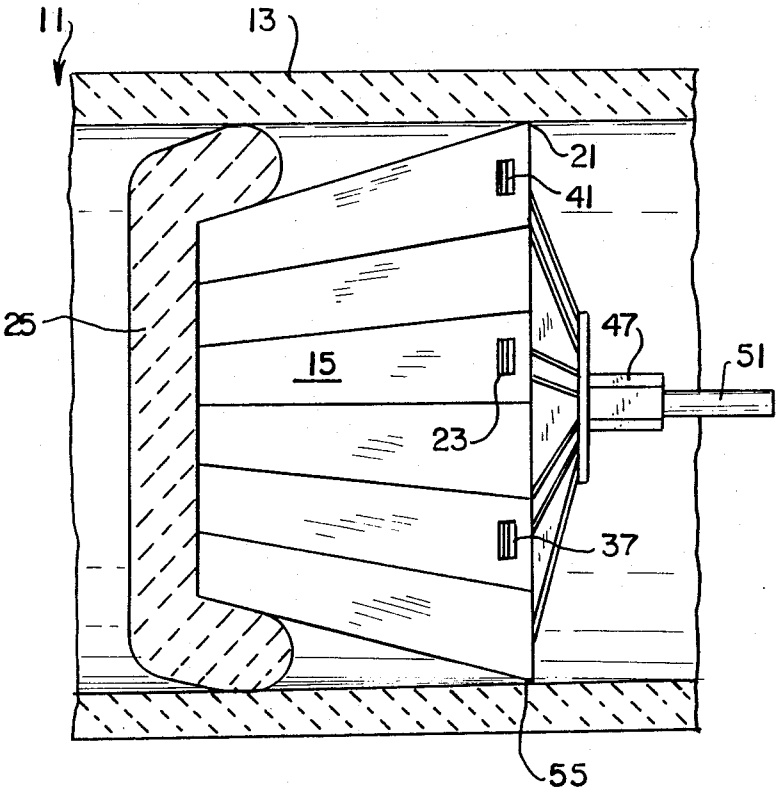
FIG. 3 is a side view of the tap hole plug of FIG. 1 in its expanded position within a tap hole.

The nose 7 of the plug 3 is protected from the heat of the contents of the metallurgical vessel 13 by a layer of insulation 25, such as ceramic wool (FIG. 3). The layer of insulation 25 should be of a size large enough to substantially block a tap hole 11 when the tap hole 11 is of the largest size that is desired before being rebuilt, but of a size small enough to be insertable within a tap hole 11 that has just been rebuilt. Typically, the diameter of a tap hole 11 ranges from about 5 inches when new to abut 8 inches before being rebuilt. Further, it should be noted that the layer of insulation 25 provides a first seal to block the contents of the metallurgical vessel 13 from flowing through the tap hole 11.

Figure 6:
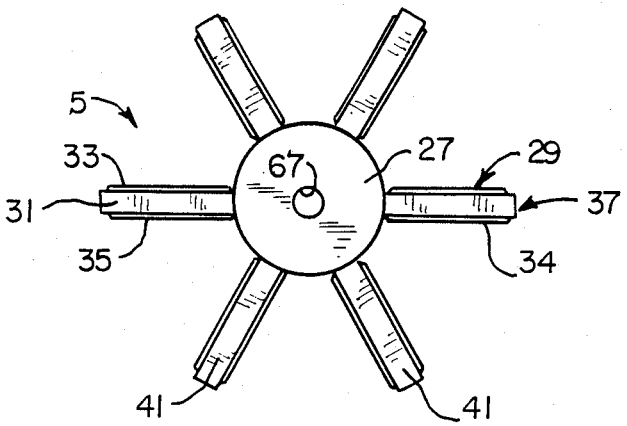
FIG. 6 is a top plan view of the expander of the tap hole plug.

The expander 5 is in the form of a truncated cone and has a base 27 and a plurality of side spokes 29 extending outwardly from the base 27 (FIG. 6). The spokes 29 form a variable obtuse angle B with respect to the base 27 that varies from about 90°, when the expander 5 is in is fully contracted position, to about 180°, when the expander 5 is in its fully expanded position. When the tap hole plug 1 is assembled, the expander 5 truncated cone is inverted with respect to the plug 3 and is attached to the plug with the side section of the expander 5 engaging the sidewall 9 of the plug 3. A plurality of spokes 29 extend radially outwardly from the base 27 of the expander 5. Preferably, the spokes 29 of the expander 5 are in three elongated sections, namely, a center section 31 and two outer sections 33, 35 located one on either side of the center section 31. The expander 5 includes a plurality of projections 37 spaced annularly about, and extending axially from, the outer edge 39 of the spokes 29 of the expander 5. Preferably, the outer sections 33, 35 of the spokes 31 of the expander 5 are slightly shorter than the center section 33 so that the outermost edge 41 of the center section 33 forms the projection 37. The projections 37 on the expander 5 are disposed within the slots 23 in the vanes 15 of the plug 3 to secure the expander 5 to the plug 3.

The tap hole plug 1 of the invention further includes means 43 for varying the angle B between the spokes 29 and the base 27 of the expander 5 to, in turn, vary angle A between the sidewall 9 of the plug 3 relative to the nose 7 thereof to block the tap hole. Increasing the angle B causes the expander 5 to apply an expanding force to the plug 3 to radially expand the sidewall 9 of the plug 3 to a size sufficient that the plug 3 substantially blocks a tap hole 11. The location on the plug 3 through which the expanding force is applied to the plug 3 is substantially the same as the location on the plug 3 at which the plug 3 contacts the wall tap hole 11.

Figure 4:
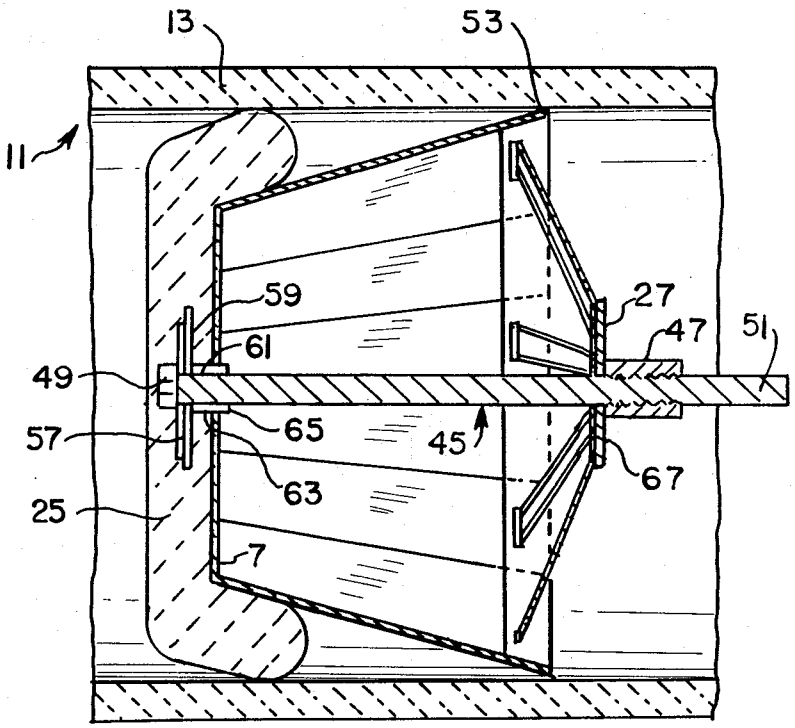
FIG. 4 is a cross-sectional view of the tap hole plug of FIG. 1 in its expanded condition within a tap hole.

The tap hole plug 1, as illustrated in the figures, includes a cap screw 45 extending between the nose 7 of the plug 3 and the base 27 of the expander 5, and a coupling nut 47. The cap screw 45 includes a head 49 and a threaded shaft 51. The coupling nut 47 abuts the base 27 of the expander 5. The distance between the nose 7 of the plug 3 and the base 27 of the expander 5 can be varied by tightening or loosening the coupling nut 47 on the shaft 51 of the cap screw 45. As the coupling nut 47 is tightened, the distance between the nose 7 of the plug 3 and the base 27 of the expander 5 is shortened. The angle B of the spokes 29 of the expander 5 with respect to the base 27 of the expander 5 increases so that the expander 5 applies an expanding force to the sidewall 9 of the plug 3 to, in turn, increase the angle A of the sidewall 9 of the plug 3 with respect to the nose 7 until the plug 3 substantially blocks the tap hole 11. The expanding force is applied to the sidewall 9 of the plug 3 at substantially the same location as the contact between the outer surface 53 of the sidewall 9 of the plug 3 and the inner surface 55 of the tap hole 11 (FIGS. 3 and 4). The seal between the outer surface 53 of the sidewall 9 of the plug 3 and the inner surface 55 of the tap hole 11 is substantially liquid and solid tight. Because the layer of insulation 25 provides a first, substantially tight liquid and solid seal as well, very little of the liquid or solid in the tap hole 11 reaches the seal between the plug 3 and the tap hole 11.

It can be readily understood that the cap screw 45 can be replaced by a threaded rod having a nut disposed at either end. The position of one of the nuts on the threaded rod may be fixed, such as by welding.

The tap hole plug 1 of the invention can be assembled by threading a flat washer 57 and then a square washer 59 over the shaft 51 of the cap screw 45 until the flat washer 57 abuts the head 49 of the screw 45. A nut 61 is threaded over the shaft 51 and is tightened against the washers 57 and 59 to hold the washers 57 and 59 stationary with respect to the shaft 51. Next, the layer of insulation 25, and then the plug 3 are secured over the shaft 51 encapsulating the head 49 of the cap screw 45, the washers 57 and 59, and nut 61. The nose 7 of the plug 3 includes a bore 63 therein to enable the plug 3 to be threaded over the shaft 51. A second nut 65 is then threaded over the shaft 51 and is tightened against the plug 3 to hold the layer of insulation 25 and the plug 3 stationary with respect to the shaft 51.

Next, the expander 5 is inverted with respect to the plug 3 and is placed over the shaft 51, and the projections 37 of the spokes 29 of the expander 5 are inserted within the slots 23 in the vanes 15 of the plug 3. The outermost edges 41 are bent to prevent sliding movement of the spokes 31 with respect to the slots 23. The base 27 of the expander 5 includes a bore 67 therein to enable the expander 5 to be placed over the shaft 51. Lastly, the coupling nut 47 is threaded onto the shaft 51 and is tightened to the desired degree.

The tap hole plug 1 of the invention is positioned within a tap hole 11 from the outside of the metallurgical vessel 13 by inserting the layer of insulation 25, at the nose 7 of the plug 3 into the tap hole 11 first. When the plug 3 is approximately one half way through the tap hole 11, a tool such as a socket wrench can be used to tighten the coupling nut 47 on the shaft 51 of the cap screw 45 to expand the expander 5, which in turn applies an expansion force to the plug 3 and expands the plug 3 until the outer surface 53 of the sidewall 9 of the plug 3 contacts the inner surface 55 of the tap hole 11 and the plug 3 substantially blocks the tap hole 11.

What is claimed is:

1. An expandable tap hole plug comprising:

a plug comprising a cylindrical member having a circular nose and an outwardly extending flexible sidewall forming a variable obtuse angle with respect to said nose, said plug being adapted to be oriented within a tap hole of a metallurgical vessel with said nose directed towards the interior of said vessel;

an expander in the form of a truncated cone, having a base and a flexible side section extending outwardly from said base forming a variable obtuse angle with respect to said base, said expander being inverted relative to said plug and attached to said plug with said side section of said expander engaging said sidewall of said plug; and means for varying said angle between said side section and said base of said expander so as to vary said angle of said sidewall of said plug relative to said nose thereof to block said tap hole.

2. The tap hole plug of claim 1 wherein the location on said sidewall of said plug through which the expanding force acts on said plug through said side section of said expander to vary said angle between said nose and said sidewall of said plug is substantially the same as the location on the outer surface of said sidewall of said plug at which said sidewall of said plug contacts the inner surface of said tap hole.

3. The tap hole plug of claim 1 wherein said expander is partially disposed within said plug.

4. The tap hole plug of claim 1 wherein said sidewall of said plug is formed of a plurality of vanes extending radially outwardly from said base of said plug.

5. The tap hole plug of claim 4 wherein said side section of said expander is formed of a plurality of spokes extending radially from base of said expander.

6. The tap hole plug of claim 5 wherein a plurality of slots are provided spaced annularly about said sidewall of said plug and a plurality of projections are provided spaced annularly about, and extending axially from, the outermost edges of said spokes of said expander, said profections being insertable within said slots of said plug to attach said expander to said plug.

7. The tap hole plug of claim 1 wherein said means for varying said angle is a cap screw extending between said nose of said plug and said base of said expander, and a coupling nut threaded on the shaft of said cap screw so that said base of said expander is disposed between said nose of said plug and said coupling nut, the distance between said nose of said plug and said base of said expander being varied by tightening or loosening said coupling nut with respect to said cap screw, such that when the distance between said nose and said base is shortened, the angle of said side section of said expander with respect to said base of said expander increases, and said expander applies said expanding force to said sidewall of said plug to increase the angle of said sidewall of said plug with respect to said nose of said plug to expand said sidewall of said plug to the point at which said plug substantially blocks a said tap hole.

8. An expandable tap hole plug comprising:

a plug comprising a cylindrical member having a circular nose and an outwardly extending flexible sidewall forming a variable obtuse angle with respect to said nose, said plug being adapted to be oriented within a tap hole of a metallurgical vessel with said nose directed towards the interior of said vessel;

an expander in the form of a truncated cone, having a base and a plurality of spokes extending outwardly from said base forming a variable obtuse angle with respect to said base, said expander being inverted relative to said plug and attached to said plug with said side section of said expander engaging said sidewall of said plug;

a plurality of slots spaced annularly about said sidewall of said plug;

a plurality of projections spaced annularly about, and extending axially from, the outermost edges of said spokes of said expander, said projections being insertable within said slots of said sidewall of said plug to attach said expander to said plug;

a cap screw extending between said nose of said plug and said base of said expander;

a coupling nut threaded on the shaft of said cap screw so that said base of said expander is disposed between said nose of said plug and said coupling nut;

said angle that said spokes of said expander form with said base of said expander being variable by tightening or loosening said coupling nut on said shaft of said cap screw to apply an expanding force to said plug to radially expand said sidewall of said plug to a size sufficient so that said plug substantially blocks a said tap hole, the location on said plug through which said expanding force is applied to said plug being substantially the same as the location on the outer surface of said plug at which said plug contacts the inner surface of said tap hole.

9. The tap hole plug of claim 8 wherein said sidewall of said plug is formed of a plurality of vanes extending radially outwardly from said base of said plug.

* * * * *